United States Patent [19]

Lönner et al.

[11] Patent Number: 4,760,626

[45] Date of Patent: Aug. 2, 1988

[54] GUIDING AND SPREADING DEVICE

[75] Inventors: Wolfgang Lönner, Neusäss; Franz Mair, Augsburg, both of Fed. Rep. of Germany

[73] Assignee: Erhardt & Leimer GmbH, Augsburg, Fed. Rep. of Germany

[21] Appl. No.: 22,242

[22] Filed: Mar. 5, 1987

[30] Foreign Application Priority Data

Mar. 5, 1986 [DE] Fed. Rep. of Germany ..... 3607233

[51] Int. Cl.[4] ..... D06C 3/06

[52] U.S. Cl. ..... 26/75; 26/105; 226/20

[58] Field of Search ..... 26/75, 105; 226/15, 226/18, 19, 20

[56] References Cited

U.S. PATENT DOCUMENTS 3,554,423 1/1971 Alexeff ..... 226/19 X
4,062,094 12/1977 Kuroda ..... 26/75
4,097,973 7/1978 Cho ..... 26/97 X
4,224,724 9/1980 Bassani et al. ..... 26/75
4,291,441 9/1981 Bassani ..... 26/75

FOREIGN PATENT DOCUMENTS 3212176 10/1983 Fed. Rep. of Germany ..... 26/75
2045291 10/1980 United Kingdom ..... 26/105

*Primary Examiner*—Robert R. Mackey
*Attorney, Agent, or Firm*—Collard, Roe & Galgano

[57] ABSTRACT

There is disclosed a device for guiding and spreading out a moving material web, which includes a spreading station, a guide station and at least one edge-sensing system downstream from the guide station. The spreading station is arranged downstream from the guide station, so that very high web speeds can be realized because the web corrections are executed very gently and without whipping up the correcting pulses.

4 Claims, 1 Drawing Sheet

GUIDING AND SPREADING DEVICE

BACKGROUND OF THE INVENTION

1. Field of the Invention

The present invention relates generally to a device for guiding and spreading a moving web of material. More particularly, the present invention relates to such a device wherein deviations in the direction of movement of the material web are corrected.

2. Description of Prior Art

A device of this type is disclosed in German published patent disclosure DE-OS No. 3,212,176 (FIGS. 4 and 5). In this German patent application the material web is placed between two spaced-apart fixed rolls in a 180° loop across two guide rolls of the guide station supported in a rotary frame, wherein the downstream guide roll is followed by a spreading roll, which is pressed against the bottom side of the material web in the section of the web extending from the guide roll to the down stream fixing roll. The spreading roll is movable parallel with its axis and parallel with the fixing roll, and is forced against the material web by its own weight and by its drive. The edge-sensing system is arranged between the guide station and the spreading roll. The spreading effect of the spreading roll is adequate as long as the material web is running on the desired course. However, if the material web runs off-course, the web placed in the loop of the web across the guide station cannot be corrected to the desired extent because when running off-course, the segment of the web extending from the last guide roll to the fixing roll is distorted by the correction movement of the guide frame, and stretched significantly more along the edge disposed on the off-course side than the segment of the web on the opposite side. At the same time, due to the distortion on the off-course side, this segment of the web is lifted from the spreading roll, or at least relieved therefrom to such an extent that the spreading effect is negated on this side of the web, and lengthwise folds are formed in this segment near the edge due to increased tension. The web is greatly stressed mechanically when subjected to such distortion. The folds which result on the off-course side are undesirable in that they falsely "ionform" the edge sensor located on the off-course side, that the edge of the web is in a position conforming to the desired alignment, whereupon the edge sensor will prematurely interfere with the correcting action. Furthermore, a particularly detrimental effect is that the web deflected on the guide rolls is not very effectively supported thereby. Thus, the reactive force resulting from the motion by which the guide station distorts the segment up to the fixing roll as it is running off the guide station, whereby the latter, furthermore attempts to shift the edge of the web opposite the off-course side on the gripping surface of the spreading roll in the correcting direction, may cause slippage of the web on the downstream guide roll towards the off-course side, and thereby delay correcton. Consequently, due to the fact that the formation of folds on the off-course side causes the edge sensor on that side to prematurely interfere with the correction action, and that such correction is sluggish to begin with, the web will only slowly return to the desired alignment. Undesirable slow oscillation cannot be suppressed at high web speeds. Finally, a relatively large amount of space is required to accommodate the guide station, and due to the required loop of the web, a great length of unused web is also needed.

In another device of this type disclosed in German Patent DE-AS No. 1,499,060, there is no provision made for a spreading roll in connection with a web guiding device. In this device, the guide rolls are seated with both of their ends on swinging frames of the device via costly joint connections, with one of such frames being provided for each roll. This frame is engaged by adjustment cylinders for adjusting the angular position of at least one guide roll relative to the web, and thereby the looping around the roll.

In another guiding and spreading device, which is disclosed in British Patent Specification No. 1,186,039, three finger-like spreading rolls are disposed on each side of the web and supported in such a way that their angle relative to the edge of the web and thus their looping by the web can be individually adjusted on each side. The spreading rolls have a dual function in that they both guide and spread. Both devices according to the German and British disclosures do not permit high web speed. Furthermore, they have a spreading and guiding influence only on the extended edge zones of the web.

It is, therefore, the object of the present invention to provide an improved device of the type described above, whereby the material web is flawlessly guided and spread even at high web running speeds.

SUMMARY OF THE INVENTION

The above object is accomplished in accordance with the present invention by a device wherein the spreading roll, with at least one additional spreading roll disposed parallel thereto, is arranged in a spreading station in which the material web coming from the guide station is maintained in the shape of an "S", and the spreading station and the fixing roll are arranged approximately in the line of extension of the plane in which there are disposed at least the axes of the first and last guide rolls, in a way such that the web segment approaching the guide station and up to the fixing roll runs in a straight line, with the exception of its run across the guiding and spreading rolls.

Since in this embodiment of the device, the web runs between the fixing rolls and through the guiding and spreading stations in a substantially straight line, it can be solidly supported both in the guiding and spreading stations without mechanical overstressing, thereby enhancing the effectiveness of the guide rolls and the spreading rolls. When corrected in the guide station, the web will no longer slip sideways as the guide rolls act on it from both sides. The surfaces of the spreading rolls continue to act on both sides of the web, even while the run of the web through the guide station is being corrected, because they operate in substantially the same plane as the guide rolls in the guide station. This has the effect that the web, when exiting from the guide station, has already been shifted to where it should have been shifted by the correcting movement, and that it is effectively spread by the spreading rolls without distortion, namely sideways in both directions and across its entire width. By virtue of the stretching within the edge zone on the side opposite the off-course side, the desired correcting pulse is nevertheless amplified by the spreading rolls. As the lengthwise folds are reliably eliminated within both edge zones of the material web, the edge sensors will scan exact actual positions, which, together with the slip-free gripping of the guide station, promotes quick and finely tuned corrections. Off-course movements of the web are eliminated quickly and without "oversteering" even at high web running speeds, for example 300 m/min. Furthermore, the web always passes the edge sensors in a uniformly spread out condition, so that the sensors can be designed with a narrow tolerance range, which is useful with high web running speeds.

If the sensing system is arranged after the spreading station, the edge sensors accurately sense the actual edge positions as they scan not only the correction effect of the guide station, but also the spreading effect of the spreading station on the web. By firmly gripping the web with the spreading rolls, the spreading station has a damping effect on variations in the run of the web, which has a positive influence on the control behavior of the device. When correcting, the guide station is not required to "oversteer" the web and therefore does not need to counter-control. The guide station is gradually retracted from its correcting position once the sensing system has detected that the web is in the process of returning to its desired course in the direction of the desired alignment. Furthermore, a positive feature is that the sensing system does not require a wide tolerance range within which it does not produce and transmit to the guide station a control signal, but operates within a narrow tolerance range, responding with high sensitivity to off-course movements of the web and emitting correction signals immediately as the web begins to run off course.

A switch off device for the sensing system installed in the signal transmission line from the sensing device to the driving elements eliminates the danger of increasingly swinging the guide station sideways when the web stands still, which could cause the non-moving web to tear or to be excessively stretched. The switch-off device serves to either switch-off the sensing system or break the signal-transmitting connection.

The guide station is provided with three guide rolls, and is simple in terms of its construction and functionally reliable, since the web is carefully treated and yet safely supported therein. The correcting movements of the guide station are effectively transmitted to the web without noticeably causing the web to slip sideways.

Also useful are the two spreading rolls of the spreading station around which the web is looped in the shape of an "S". The spreading rolls act forcefully on the web across the full width thereof if they engage both sides of the web, and if they can be readily adapted to the quality of the web material being processed via the selected looping and their driving speed.

It is also useful if only finger-shaped spreading rolls are arranged in both edge zones mounted in floating supports, so that spreading is effected very efficiently and substantially within the edge zones of the web, permitting the edge-sensing system to precisely scan the crease-free edge zones. The degree of looping, and thus the intensity of the action of the spreading rolls can be altered simply by adjusting the spreading rolls around the axis extending perpendicular to the running direction of the web.

BRIEF DESCRIPTION OF THE DRAWING

Embodiments of the object of the invention are explained in greater detail in the following description, reference being had to the drawing in which.

DESCRIPTION OF THE PREFERRED EMBODIMENT

Figure 2:
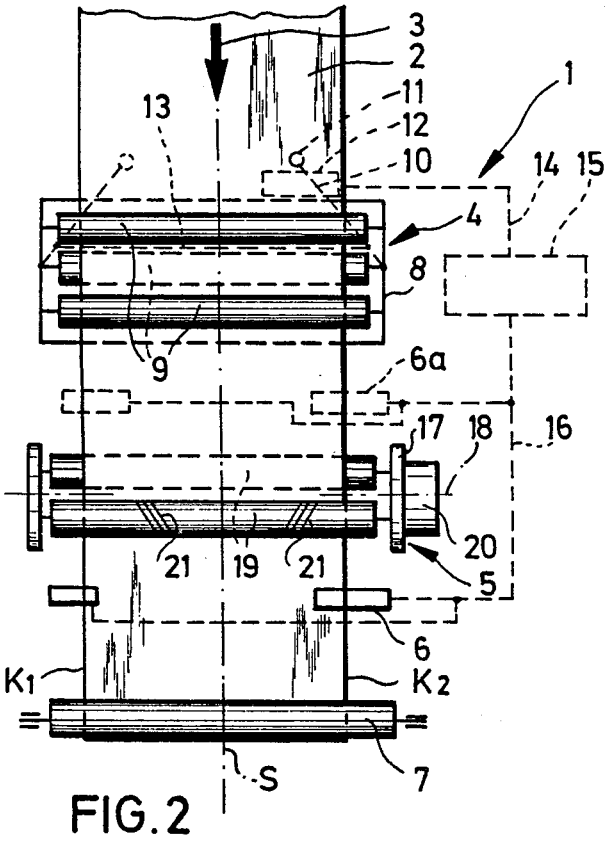
FIG. 2 is a top plan view of the device shown in FIG. 1.
Figure 1:
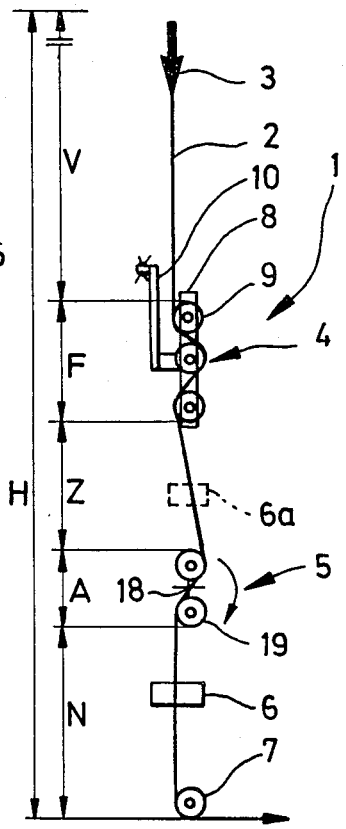
FIG. 1 is a side elevational view of a web guiding and spreading device according to the present invention.

In FIGS. 1 and 2, a device 1 for guiding and spreading out a moving material web 2 is shown. Material web 2 moves in the direction indicated by arrow 3. Device 1 is comprised of a guide station 4 and a spreading station 5, the latter being downstream from the former in the direction 3 of web 2. At least one edge K1 or K2 of web 2 is scanned by a sensing system 6 or *6a*. Sensing system 6 is arranged downstream of spreading station 4 in the moving direction 3 of the web, or sensing system *6a* shown in phantom is arranged between guide station 4 and spreading station 5. Downstream from spreading station 5, web 2 runs around a fixing roll 7. The desired alignment S of web 2 is indicated in FIG. 2 by the dash-dot line.

Guide station 4 has a frame-like carrier 8 rotatably supporting three guide rolls 9, which are disposed parallel with one another. Carrier 8 is displaceable sideways in guides not shown in the drawing, and angularly adjustable relative to the moving the direction 3 of the web. By means of steering rods 10, rotatably supported in the swinging axles 11, carrier 8 can be pivoted out and displaced sideways in both directions (shown, for example, in FIG. 3).

Steering rods 10, which are connected with each other (for example, by means of a crosstie 13), are engaged by driving elements 12, which are connected to a control device 15 by cable 14. From control device 15, another cable 16 leads to sensing system 6 or *6a* in order to be supplied, or receive from the latter signals conforming to off-course movements of the web, so that the displacement and swinging motion of the carrier 8 can be controlled by such signals.

In fixed spreading station 5, two spreading rolls 19 are supported parallel with one another in supporting elements 17. Spreading rolls 19 are displaceable by means of their own drive 20 by a rotary motion in contrary direction relative to the run of the web. Supporting elements 17 may be rotated around axis 18, or one spreading roll 19 may be rotated around the other in order to change the looping of web 2, which passes between spreading rolls 19 in a course having the shape of an "S". Preferably, spreading rolls 19 have a structuring 21 on their surfaces, which extends from the center of each roll outwardly. By means of this structuring, the spreading rolls effect a spreading action on web 2.

Device 1 is normally installed vertically so that web 2 is guided from the top down and doesn't sag within this zone. The total height "H" should be at least 4.5 meters in order to have a free lead distance "V" of at least 3 meters. Because of this web free lead run, the error of sideways off-course displacement from the desired alignment "S" can be corrected by the roll controller or guide station 4 without any interference. Guide station 4 with its three rolls requires a length "F" of about 0.45 meter; spreading station 5 with its two spreading rolls, which can be pivoted parallel against each other and change the looping angle, requires a length "A" of about 0.15 meter. As an after-run "N" of about 0.2 to 0.3 meter is preferred, an intermediate spacing "Z" of about 0.3 meter remains between guide station 4 and spreading station 5.

Figure 3:
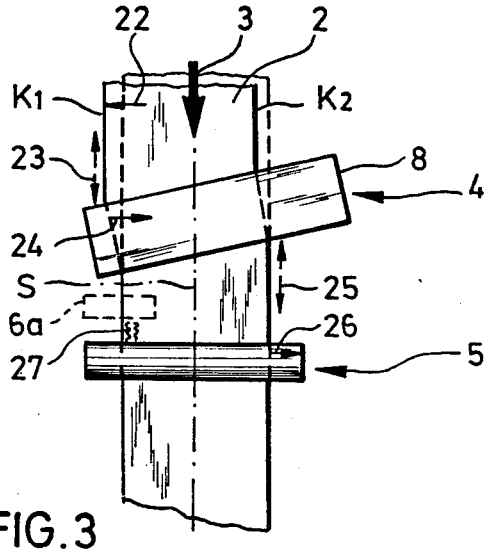
FIG. 3 is a schematic top plan view showing the device in operation.

The operation of the device 1 of FIGS. 1 and 2 is explained with the help of FIG. 3, assuming that web 2 runs off course to the left in the direction indicated by arrow 22 in FIG. 3. With such off-course movement in the direction of arrow 22, both the left edge K1 and the right edge K2 shift to the left. Sensing system *6a* detects the off-course movement of web 2 and starts to control a shifting and swinging movement of carrier 8, by which web 2 is to be returned to the desired alignment "S". Carrier 8 is shifted to the right and rotated counter-clockwise. This movement of carrier 8 causes the edge K1 to be subjected to tensile stress as shown by the arrows 23, so that due to the increased contact pressure by which the web is pressed against control or guide rolls 9 in carrier 8, the correcting pulse is directly transmitted to web 2. The greater edge tension in the left zone upstream of control or guide rolls 9 promotes the function of the guide station 4. At the same time, the edge K2 between guide station 4 and spreading station 5 is increasingly extended as well (arrows 25), so that due to this tension of the edge, the spreading rolls 19 in spreading station 5 apply an additional correcting pulse to the right side of web 2 in the direction indicated by arrow 26, by which additional pulse supports the correcting effect of guide station 4 (indicated by the arrow 24), and web 2 is increasingly shifted in the direction of the desired alignment "S". If, for example, folds 27 are present within the zone of edge K1, such folds are eliminated in spreading station 5. However, unfolding such folds has a retroactive effect on sensing system *6a*, so that the latter is already informed about a position of corrected edge K1 that approximately conforms to the position of edge K1 after leaving spreading station 5, so that the correction effect will come to bear very gently and exactly, because sensing system *6a* can already initiate the return of the shifting and swivelling motion of the guide station 4 once it has detected that the web starts to shift or move again towards the desired course. Neither oversteering of the guide station 4 nor counter-controlling is required, so that the control behavior is very steady and finely tuned, permitting web running speeds of up to 300 m/min.

We claim:

1. In a device for guiding and spreading out a moving material web, consisting of a guide station for guiding the material web on the desired running course including, a plurality of guide rolls movable parallel to the plane of the web and crosswise relative to the moving direction of the web for correcting the run of the web, a spreading station, including at least one spreading roll arranged downstream from the guide station for spreading out the material web transversely to the moving direction thereof, at least one edge-sensing system downstream from the guide station and being in signal-transmitting communication with driving elements for the guide rolls, and a fixing roll for the material web arranged downstream from the spreading roll, the improvement comprising:

a further spreading roll arranged in said spreading station parallel to said at least one spreading roll so that the material web is maintained in the shape of an "S" therethrough, and said spreading station and said fixing roll being arranged in a plane defined by at least the axes of the first and the last guide rolls so that the segments of the material web approaching the guide station and the fixing roll run in a straight line.

2. The device according the claim 1, wherein said sensing system is arranged downstream from the spreading station.

3. The device according to claim 1, which further comprises a switch-off device for the sensing system interconnected in the signal-transmitting communication between the sensing system and the driving elements of the guide rolls, said switich-off device being actuated when the material web stands still.

4. The device according to claim 1, wherein said guide station includes three parallel guide rolls in a carrier adapted for angular adjustment relative to the moving direction of the web, and said driving elements for said guide rolls directly engage said carrier.

* * * * *